US011528976B2

(12) United States Patent
He

(10) Patent No.: US 11,528,976 B2
(45) Date of Patent: Dec. 20, 2022

(54) MULTIFUNCTIONAL ELECTRONIC EQUIPMENT CLEANING STORAGE BOX

(71) Applicant: Yandong He, Foshan (CN)

(72) Inventor: Yandong He, Foshan (CN)

( * ) Notice: Subject to any disclaimer, the term of this patent is extended or adjusted under 35 U.S.C. 154(b) by 0 days.

(21) Appl. No.: 17/338,637

(22) Filed: Jun. 3, 2021

(65) Prior Publication Data

US 2022/0312921 A1 Oct. 6, 2022

(30) Foreign Application Priority Data

Apr. 2, 2021 (CN) ..... 202120680169.1

(51) Int. Cl.

| | |
|---|---|
| ***A45C 11/24*** | (2006.01) |
| ***A46B 15/00*** | (2006.01) |
| ***A45C 13/12*** | (2006.01) |
| ***A45C 13/02*** | (2006.01) |
| *A45C 11/00* | (2006.01) |

(52) U.S. Cl.

CPC ..... *A45C 11/24* (2013.01); *A45C 13/02* (2013.01); *A45C 13/123* (2013.01); *A46B 15/0091* (2013.01); *A45C 2011/003* (2013.01); *A45C 2013/025* (2013.01)

(58) Field of Classification Search

CPC ..... A45C 11/24; A45C 13/02; A45C 13/123; A45C 2011/003; A45C 2013/025; A46B 15/00; A46B 15/0091

See application file for complete search history.

(56) References Cited

U.S. PATENT DOCUMENTS

| | | | | |
|---|---|---|---|---|
| 2004/0200748 | A1* | 10/2004 | Klassen | A46B 15/0091 15/23 |
| 2014/0246044 | A1* | 9/2014 | Levy | A46B 15/0091 132/313 |
| 2017/0071303 | A1* | 3/2017 | Olson | A45C 11/008 |

* cited by examiner

*Primary Examiner* — Bryon P Gehman

(57) ABSTRACT

The present disclosure provides a multifunctional electronic equipment cleaning storage box, which includes a box body, a first box cover, a second box cover, a rag, a large cleaning sweep, and small cleaning sweep, an end of the box body defines a accommodating groove having an opening facing forward, the first box cover and the second box cover, being openable and closable, are disposed on the box body, in closed state, the first box cover and the second box cover are respectively enclosed with the box body to form a first accommodating cavity and a second accommodating cavity, and the first box cover defines a card slot for a mobile phone to be inserted for supporting and positioning.

10 Claims, 6 Drawing Sheets

MULTIFUNCTIONAL ELECTRONIC EQUIPMENT CLEANING STORAGE BOX

TECHNICAL FIELD

The present disclosure relates to a field of electronic equipment cleaning and care products, in particularly to a multifunctional electronic equipment cleaning storage box.

BACKGROUND

After long time use of various electronic products (such as mobile phones, computers, etc.), various contaminants, such as dust, may stick to surfaces of screens, keyboards, etc., therefore, the electronic products need to be cleaned regularly, and good maintenance of the electronic products to facilitate prolonged service life of the electronic products.

In the prior art, various tools, such as wipes, large brushes, small brushes, etc. are used to clean screens, keyboards, etc. of the various electronic products, however, the tools are relatively dispersed and are not integrated and stored together, which brings inconvenience to users. Therefore, it is necessary to provide a solution solve at least one problem mentioned above.

SUMMARY

The present disclosure aims to solve at least one problem in the prior art, a main purpose of the present disclosure is to provide a multifunctional electronic equipment cleaning storage box, which has an advantage of convenient use.

To achieve the above purpose, the present disclosure adopts the following technical solutions:

The multifunctional electronic equipment cleaning storage box includes a box body, a first box cover, a second box cover, a rag, a large cleaning sweep and a small cleaning sweep. An end of the box body defines an accommodating groove having an opening facing forward, the first box cover and the second box cover, being openable and closable, are disposed on the box body, in closed state, the first box cover and the second box cover are respectively enclosed with the box body to form a first accommodating cavity and a second accommodating cavity, and the first box cover defines a card slot for a mobile phone to be inserted for supporting and positioning. The rag is detachably disposed in the first accommodating cavity, the large cleaning sweep is disposed in the accommodating groove and movably extends out of or retracts into the accommodating groove. The small cleaning sweep is detachably disposed in the second accommodating cavity.

Optionally, a surface of the box body concavely defines a concave position. A hook and loop fastener is embedded and fixed in the concave position, the rag is a hook and loop fastener rag, the rag is fixed on the box body by the hook and loop fastener and protrudes out of the concave position.

Optionally, a side of the box body defines a guide groove extending back and front and communicating with the accommodating groove, the large cleaning sweep includes a bracket body, a large brush head, and a push button. The bracket body is disposed in the accommodating groove, and the bracket body slides back and forth along the accommodating groove. The large brush head is fixed at a front end of the bracket body and extends out of or retracts into the accommodating groove along with movement of the bracket body. The push button is fixedly connected to the bracket body and extends out through the guide groove, the push button moves back and forth along the guide groove to drive the bracket body to move back and forth.

Optionally, the push button is elastically pressed and installed on a side of the bracket body, a front end of the guide groove concavely defines a positioning groove, a positioning convex point matched with the positioning groove is disposed on an inner side of the push button.

Optionally, the box body includes an upper shell and a lower shell, and the upper shell and the lower shell are spliced up and down, buckled, fixed, and enclosed to form the accommodating groove and guide groove.

Optionally, the small cleaning sweep includes a handle, a scraping pen, an extension rod and a small brush head, the handle is in a hollow shape, and the handle defines an accommodating hole having an opening facing forward, two ends of the scraping pen are respectively matched with the accommodating hole, and the two ends of the scraping pen are inserted into the accommodating hole, an end of the scraping pen has a pen head, and an other end of the scraping pen defines an insertion hole. The extension rod is matched with the accommodating hole and is accommodated in the accommodating hole, an end of the extension rod is matched with the insertion hole and is inserted and connected with the insertion hole, the small brush head is fixed at an other end of the extension rod.

Optionally, a spray bottle for storing cleaning liquid is also disposed in the second accommodating cavity.

Optionally, the box body defines two first embedding grooves and a second embedding groove, the two first embedding grooves are spaced apart and extend longitudinally, the small cleaning sweep and the spray bottle are respectively embedded in the two first embedded grooves to be fixed, the second embedding groove extends laterally and is communicated with the two first embedding grooves, a silica gel piece is embedded in the second embedding groove, and the silica gel piece supports the small cleaning sweep and the spray bottle.

Optionally, the first box cover is bucked, installed, and fixed with the box body, and the first box cover is a transparent cover.

Optionally, the second box cover is buckled, installed, and fixed with the box body, and a keyboard buckle is clamped on an inner side surface of the second box cover.

Compared with the prior art, the present disclosure has obvious advantages and beneficial effects, specifically, it may be seen by the above technical solutions:

By setting the first box cover and the second box cover, and cooperating with the rag, the large cleaning sweep and the small cleaning sweep, so that the present disclosure integrates multiple cleaning tools together, which structure is compact and design is reasonable. Users can select corresponding tools to use according to their demands, which is very convenient to use. Moreover, the first box cover defines the card slot, so that present disclosure can be used as a mobile phone support, and more convenience is provided for the users.

To more clearly illustrate the structural features and efficacy of the present disclosure, the present disclosure is described in detail in combination with the drawings and specific embodiments.

Figure 1:
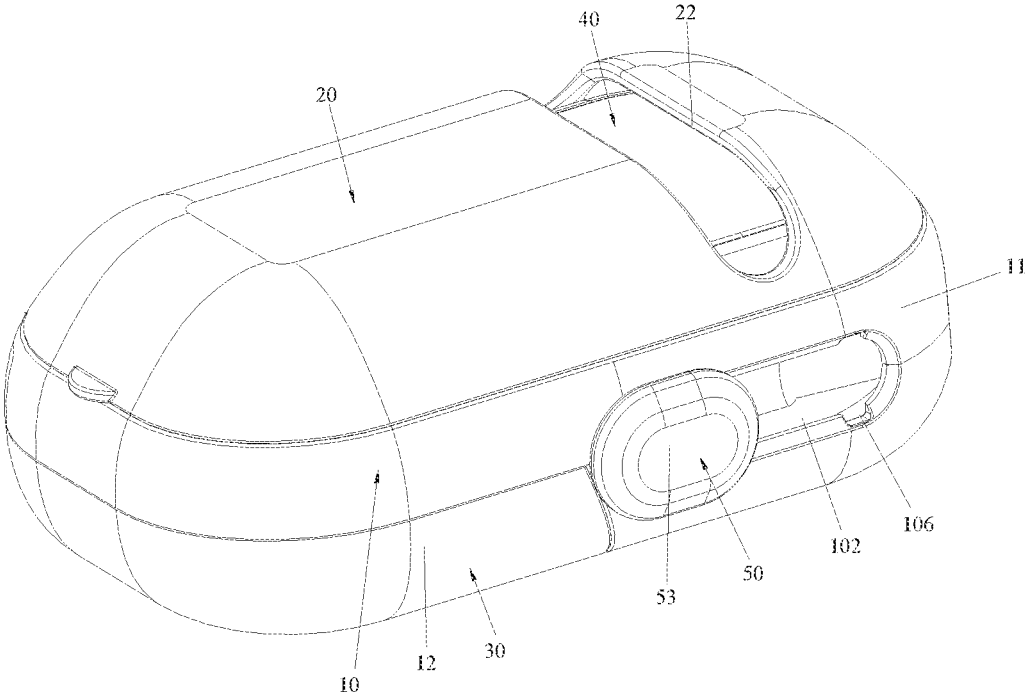
FIG. 1 is an assembled three-dimensional schematic diagram of a multifunctional electronic equipment cleaning storage box according to one embodiment of the present disclosure.
Figure 2:
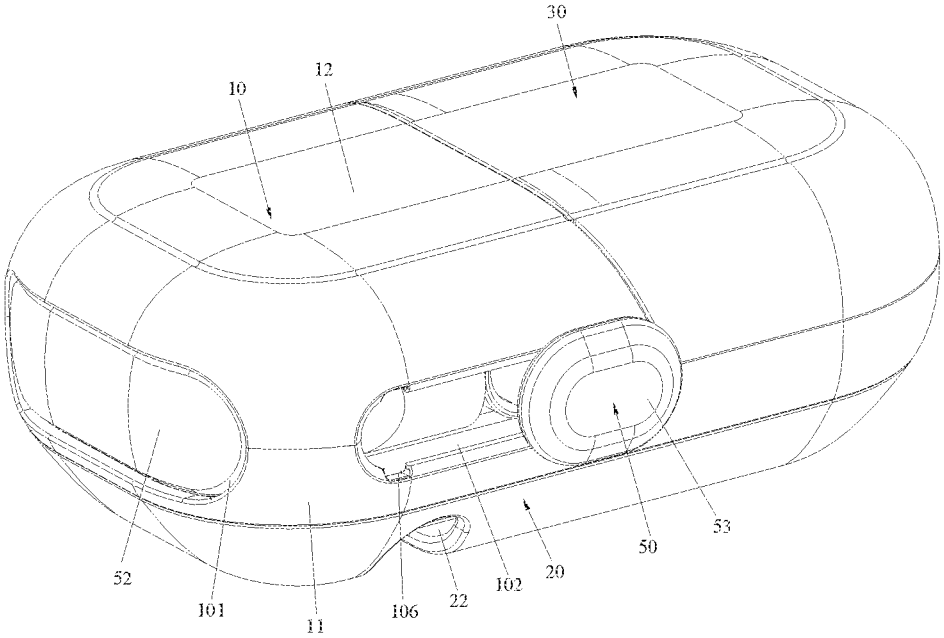
FIG. 2 is an assembled three-dimensional schematic diagram of the multifunctional electronic equipment cleaning storage box shown in another angle according to one embodiment of the present disclosure.
Figure 3:
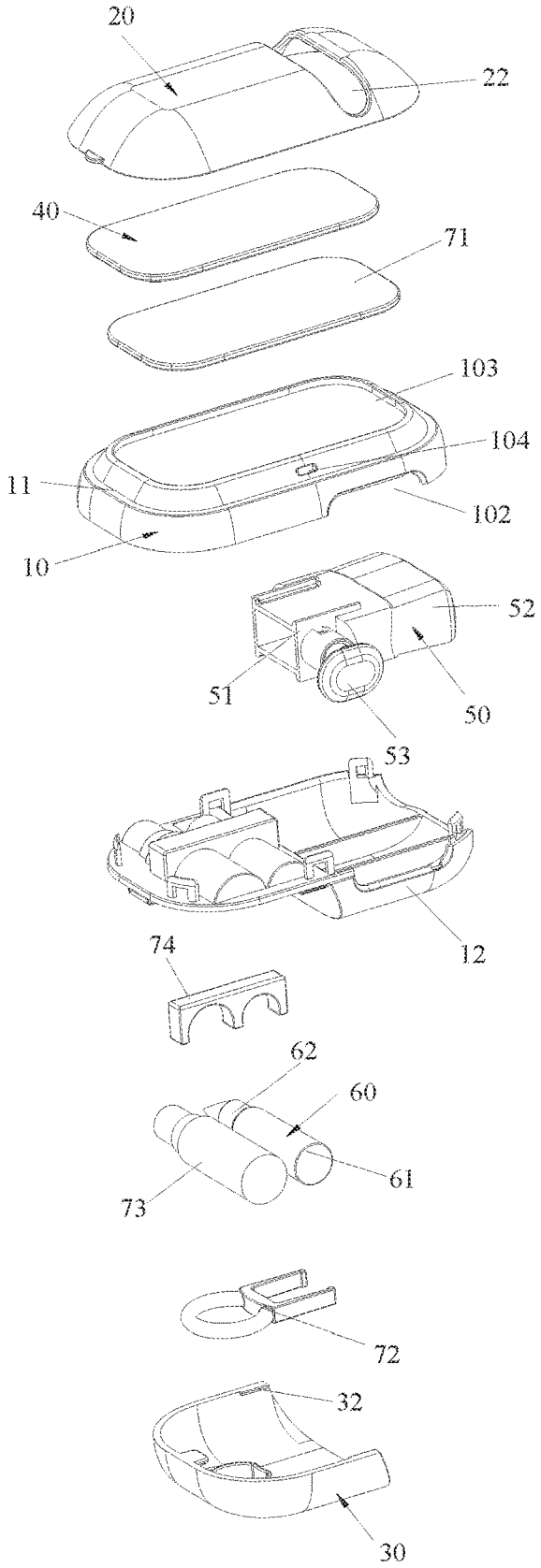
FIG. 3 is an exploded schematic diagram of the multifunctional electronic equipment cleaning storage box according to one embodiment of the present disclosure.
Figure 4:
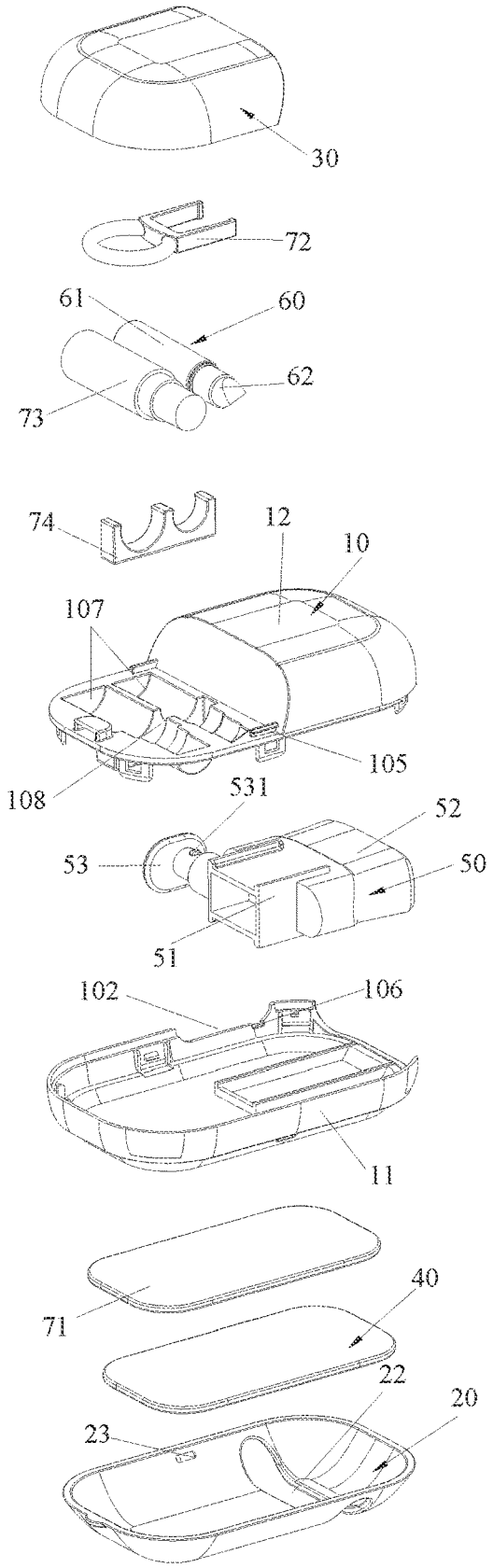
FIG. 4 is an exploded schematic diagram of the multifunctional electronic equipment cleaning storage box shown in another angle according to one embodiment of the present disclosure.
Figure 5:
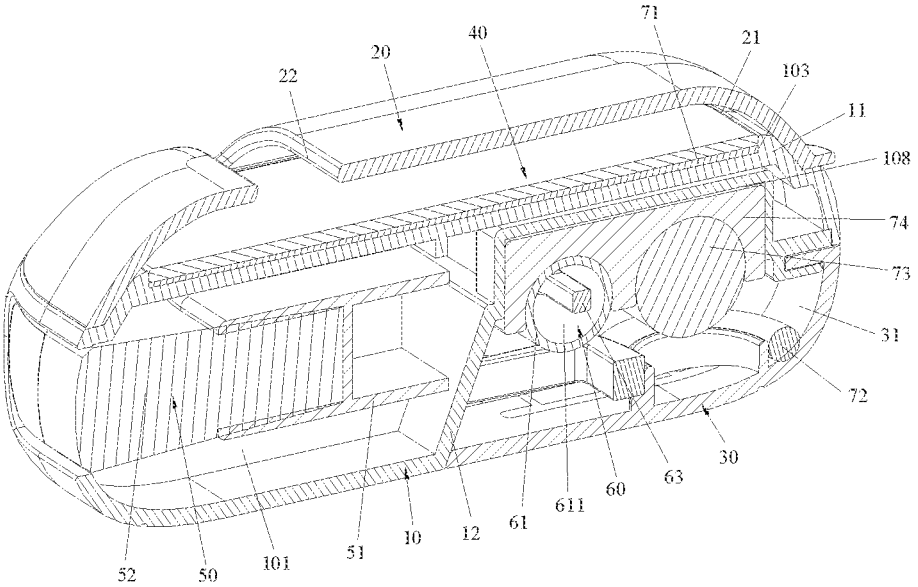
FIG. 5 is a cross-sectional schematic diagram of the multifunctional electronic equipment cleaning storage box according to one embodiment of the present disclosure.
Figure 6:
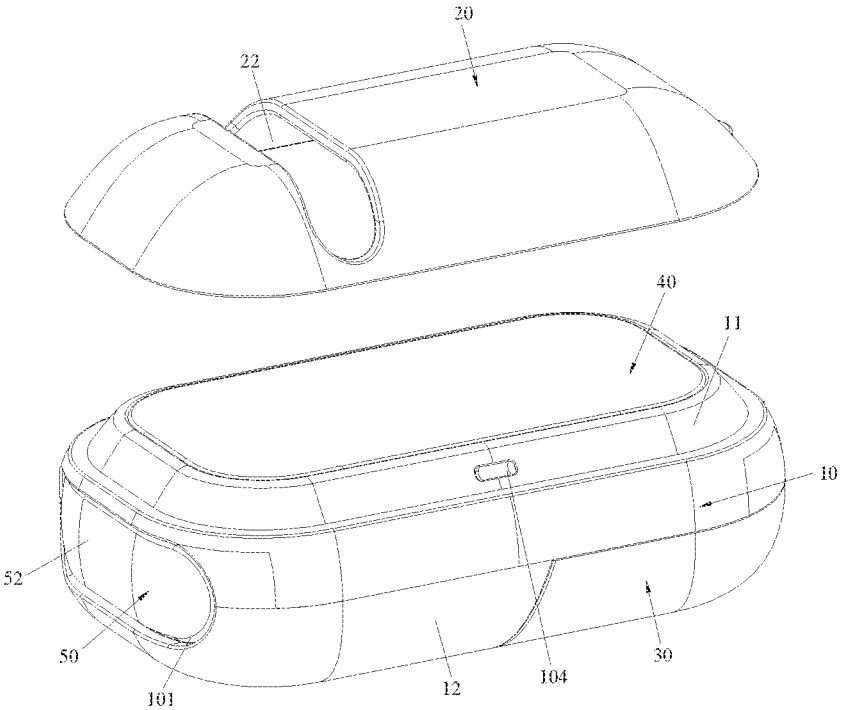
FIG. 6 is a partial assembly schematic diagram of the multifunctional electronic equipment cleaning storage box according to one embodiment of the present disclosure.
Figure 7:
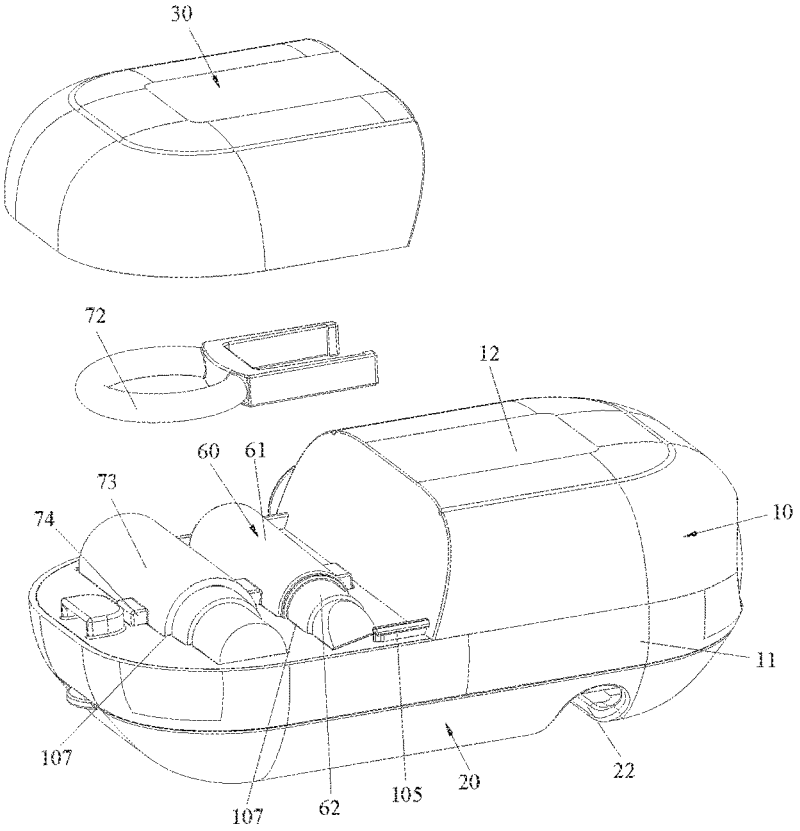
FIG. 7 is another partial assembly schematic diagram of the multifunctional electronic equipment cleaning storage box according to one embodiment of the present disclosure.

10. box body; 11. upper shell; 12. lower shell; 101. accommodating groove; 102, guide groove; 103. concave position; 104. first buckling groove; 105, second buckling groove; 106. positioning convex; 107, first embedded groove; 108. second embedded groove; 20. first box cover; 21. first accommodating cavity; 22. card slot; 23, first buckling part; 30. second box cover; 31. second accommodating cavity; 32. second buckling part; 40. rag; 50. large cleaning sweep; 51. bracket body; 52. large brush head; 53, push button; 531. positioning convex; 60. small cleaning sweep; 61. handle; 611. accommodating hole; 62. scraping pen; 621. pen head; 622. insertion hole; 63. extension rod; 64. small brush head; 71. hook and loop fastener; 72. keyboard buckle; 73. spray bottle; 74. silica gel piece.

DETAILED DESCRIPTION

Refer to FIGS. 1-11, which show a specific structure of a preferred embodiment of the present disclosure, including a box body 10, a first box cover 20, a second box cover 30, a rag 40, a large cleaning sweep 50 and a small cleaning sweep 60.

An end of the box body 10 defines an accommodating groove 101 having an outward opening. In the present embodiment, a side of the box body 10 defines a guide groove 102 extending back and forth and communicating with the accommodating groove 101. Specifically, the box body 10 includes an upper shell 11 and a lower shell 12, the upper shell 11 and the lower shell 12 are spliced up and down, buckled, fixed, and enclosed to form the accommodating groove 101 and guide groove 102. A surface of the box body 10 concavely defines a concave position 103, a hook and loop fastener 71 is embedded and fixed in the concave position 103, a surface periphery of the box body 10 concavely defines a first buckling groove 104, an other surface periphery of the box body 10 concavely defines a second buckling groove 105.

The first box cover 20 and the second box cover 30, being openable and closable, are disposed on the box body 10, in closed state, the first box cover 20 and the second box cover 30 are respectively enclosed with the box body 10 to form a first accommodating cavity 21 and a second accommodating cavity 31, and the first box cover 20 defines a card slot 22 for a mobile phone to be inserted for supporting and positioning. The card slot 22 communicates with first accommodating cavity 21. In the present embodiment, the first box cover 20 is bucked, installed, and fixed with the box body 10, and the first box cover 20 is a transparent cover, which is convenient for observing the items in the first accommodating cavity 21, and an inner side of the first box cover 20 is convexly provided with a first buckling part 23, the first buckling part 23 is buckled and fixed with the first buckling groove 104, the second box cover 30 is buckled, installed, and fixed with the box body 10, specifically, an inner side of the second box cover 30 is convexly provided with a second buckling part 32, the second buckling part 32 is buckled and fixed with the second buckling groove 105, and a keyboard buckle 72 is clamped on an inner side surface of the second box cover 30, the keyboard buckle 72 is used for taking down keys on a keyboard.

The rag 40 is detachably disposed in the first accommodating cavity 21, in the present embodiment, the rag 40 is a hook and loop fastener rag, the rag 40 is fixed on the box body 10 by the hook and loop fastener 71 and protrudes out of the concave position 103, so that users conveniently hold the box body 10 and use a rag 40 to wipe and clean the screen, etc., the rag 40 is taken down or adhered according to demands, which is very convenient to use.

The large cleaning sweep 50 is disposed in the accommodating groove 101 and movably extends out of or retracts into the accommodating groove 101. specifically, the large cleaning sweep 50 includes a bracket body 51, a large brush head 52 and a push button 53. The bracket body 51 is disposed in the accommodating groove 101, and the bracket body 51 slides back and forth along the accommodating groove 101. The large brush head 52 is fixed at a front end of the bracket body 51 and extends out of or retracts into the accommodating groove 101 along with movement of the bracket body 51. The push button 53 is fixedly connected to the bracket body 51 and extends out through the guide groove 102, and the push button 53 moves back and forth along the guide groove 102 to drive the bracket body 51 to move back and forth, and the push button 53 is elastically pressed and installed on a side of the bracket body 51, a front end of the guide groove 102 concavely defines a positioning groove 106, a positioning convex point 531 matched with the positioning groove 106 is disposed on an inner side of the push button 53, so that the push button 53 is stably positioned without backing up after the push button 53 is pushed forward in place.

The small cleaning sweep 60 is detachably disposed in the second accommodating cavity 31. Specifically, the small cleaning sweep 60 includes a handle 61, a scraping pen 62, an extension rod 63 and a small brush head 64. The handle 61 is in a hollow shape, and the handle 61 defines an accommodating hole 611 having an opening facing forward, two ends of the scraping pen 62 are respectively matched with the accommodating hole 611 and two ends of the scraping pen 62 are inserted into the accommodating hole 611, an end of the scraping pen 62 has a pen head 621, and an other end of the scraping pen 62 defines an insertion hole 622. The scraping pen 62 is made of silicone, the extension rod 63 is matched with the accommodating hole 611 and is accommodated in the accommodating hole 611, an end of the extension rod 63 is matched with the insertion hole 622 and is inserted and connected with the insertion hole 622, the small brush head 64 is fixed at an other end of the extension rod 63.

A spray bottle 73 for storing cleaning liquid is also disposed in the second accommodating cavity 31, the box body 10 defines two first embedding grooves 107 and a second embedding groove 108, the two first embedding grooves 107 are spaced apart and extend longitudinally, the small cleaning sweep 60 and the spray bottle 73 are respectively embedded in the two first embedded grooves 107 to be fixed, the second embedding groove 108 extends laterally and is communicated with the two first embedding grooves 107, a silica gel piece 74 is embedded in the second embedding groove 108, and the silica gel piece 74 supports the small cleaning sweep 60 and spraying bottle 73.

The usage method of the present embodiment is described in detail below.

Figure 8:
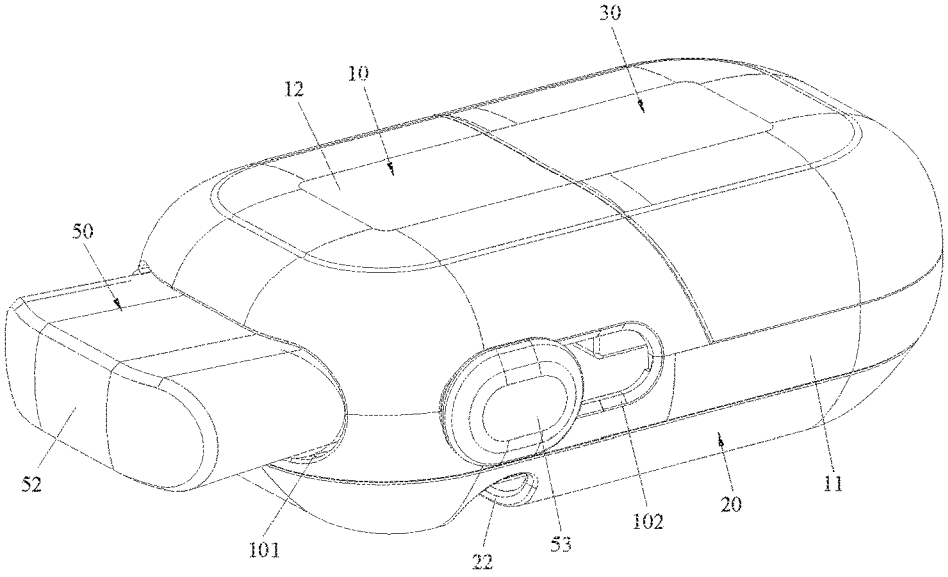
FIG. 8 is a schematic diagram of the multifunctional electronic equipment cleaning storage box being in a using state according to one embodiment of the present disclosure.

When cleaning with the large cleaning sweep 50, as shown in FIG. 8, pushing the push button 53 forward into place, so that the large brush head 52 extends forwardly out of the accommodating groove 101 to be positioned, at this time, holding the box body 10 and using the large brush head 52 to clean the electronic device, after cleaning, pressing the push button 53 inward first, and then sliding the push button 53 backward, so that the large brush head 52 retracts back into the accommodating groove 101 to achieve a purpose of hiding and storing.

When wiping with the rag 40, opening and removing the first box cover 20, then holding the box body 10 and using the rag 40 to wipe and clean the screens, etc., after cleaning, closing the first box cover 20, when cleaning the soiled rag 40, the rag 40 may be teared off for cleaning.

When supporting the mobile phone, clamping the mobile phone in the card slot 22, so that the multifunctional electronic equipment cleaning storage box may be used as a mobile phone holder to support the mobile phone, which is convenient for users to use the mobile phone.

Figure 9:
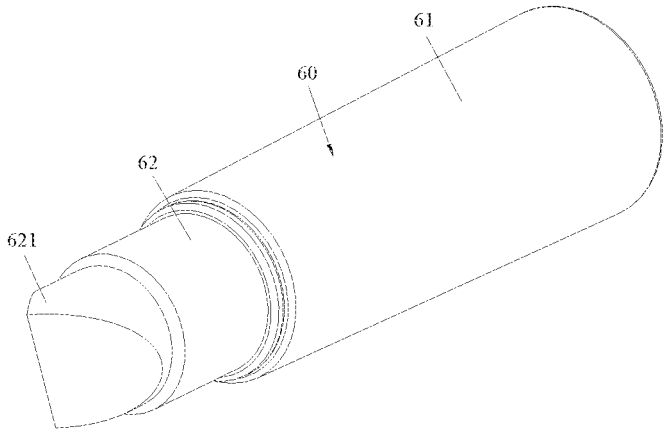
FIG. 9 is an enlarged schematic diagram of a scraping pen according to one embodiment of the present disclosure.
Figure 10:
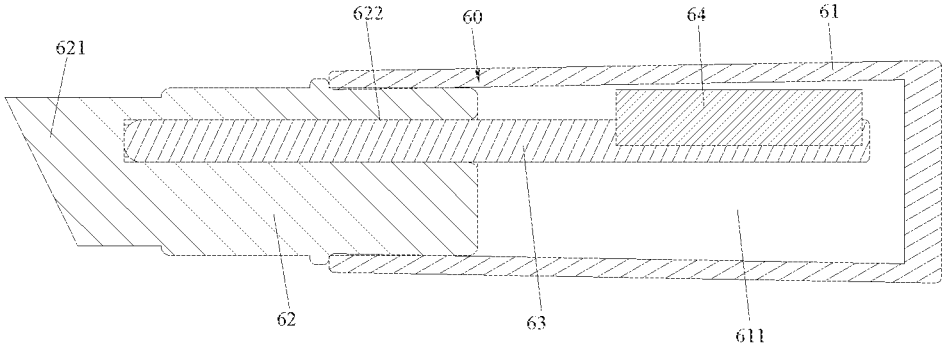
FIG. 10 is a cross-sectional diagram of a small cleaning sweep according to one embodiment of the present disclosure.
Figure 11:
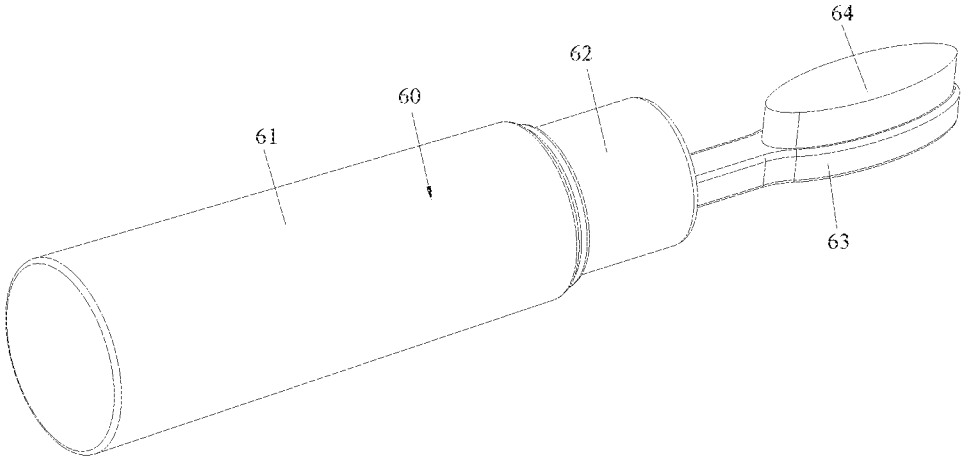
FIG. 11 is a schematic diagram of the small cleaning sweep being in another using state according to one embodiment of the present disclosure.

When using the small cleaning brush 60 to clean, opening the second box cover 30, then taking down the small cleaning brush 60, when using the scraping pen 62 to scrape, as shown in FIG. 9, installing the scraping pen 62 with the pen head 621 outwardly, at this time, holding the handle 61 and using the pen head 621 to scrape an outside, when using the small brush head 64 to clean, as shown in FIG. 11, installing the scraping pen 62 with the small brush head 64 outwardly, at this time, holding the handle 61 and using the small brush head 64 to clean the outside. After using, reaccommodating the small cleaning brush 60 into the second accommodating cavity 31, and then closing the second box cover 30.

When disassembling the keys of the keyboard, opening the second cover 30, then taking down the keyboard buckle 72, and using the keyboard buckle 72 to remove the keys of the keyboard.

During the above cleaning process, the spray bottle 73 is taken down to spray the cleaning liquid to do better cleaning.

The design key of the present disclosure is as follows: by setting the first box cover, and the second box cover, and cooperating with the rag, the large cleaning sweep, and the small cleaning sweep, so that the present disclosure integrates multiple cleaning tools together, which structure is compact and design is reasonable. Users can select corresponding tools to use according to their demands, which is very convenient to use. Moreover, the first box cover defines the card slot, so that the present disclosure can be used as a mobile phone support, and more convenience is provided for the users.

The above description is only preferred embodiments of the present disclosure, and is not intended to limit the technical scope of the present disclosure. Therefore, any subtle modifications, equivalents and modifications made in the above embodiments in accordance with the technology of the present disclosure are all within the scope of the technical solution of the present disclosure.

What is claimed is:

1. A multifunctional electronic equipment cleaning storage box, comprising:

a box body;

a first box cover;

a second box cover;

a rag;

a large cleaning sweep; and a small cleaning sweep;

wherein an end of the box body defines an accommodating groove having an opening facing outward; the first box cover and the second box cover are disposed on the box body, where the first box cover and the second box cover are configured to be assemblable and disassemblable; and when the first box cover and the second box cover are assembled, the first box cover and the second box cover are respectively enclosed with the box body to form a first accommodating cavity and a second accommodating cavity, and the first box cover defines a card slot for a mobile phone to be inserted for supporting and positioning; the rag is detachably disposed in the first accommodating cavity; the large cleaning sweep is disposed in the accommodating groove and movably extends out of or retracts into the accommodating groove;

the small cleaning sweep is detachably disposed in the second accommodating cavity.

2. The multifunctional electronic equipment cleaning storage box according to claim 1, wherein a surface of the box body concavely defines a concave position, a hook and loop fastener is embedded and fixed in the concave position, the rag is a hook and loop fastener rag, the rag is bonded and fixed on the box body by the hook and loop fastener and protrudes out of the concave position.

3. The multifunctional electronic equipment cleaning storage box according to claim 1, wherein a side of the box body defines a guide groove penetrating through the box body and communicating with the accommodating groove, the large cleaning sweep comprises a bracket body, a large brush head, and a push button; the bracket body is disposed in the accommodating groove, and the bracket body slides back and forth along the accommodating groove; the large brush head is fixed at a front end of the bracket body and extends out of or retracts into the accommodating groove along with movement of the bracket body; the push button is fixedly connected to the bracket body and extends out through the guide groove, the push button moves back and forth along the guide groove to drive the bracket body to move back and forth.

4. The multifunctional electronic equipment cleaning storage box according to claim 3, wherein the push button is elastically installed on a side of the bracket body, and the push button is pressable, a front end of the guide groove concavely defines a positioning groove, a positioning convex point matched with the positioning groove is disposed on an inner side of the push button.

5. The multifunctional electronic equipment cleaning storage box according to claim 3, wherein the box body comprises an upper shell and a lower shell, the upper shell and the lower shell are spliced up and down, buckled, fixed, and enclosed to form the accommodating groove and the guide groove.

6. The multifunctional electronic equipment cleaning storage box according to claim 1, wherein the small cleaning sweep comprises a handle, a scraping pen, an extension rod and a small brush head; the handle is in a hollow shape, and the handle defines an accommodating hole having an opening facing forward, two ends of the scraping pen are respectively matched with the accommodating hole, and the two ends of the scraping pen are inserted into the accommodating hole, an end of the scraping pen has a pen head, and an other end of the scraping pen defines an insertion hole; the extension rod is matched with the accommodating hole and is accommodated in the accommodating hole, an end of the extension rod is matched with the insertion hole and is inserted and connected with the insertion hole, the small brush head is fixed at an other end of the extension rod.

7. The multifunctional electronic equipment cleaning storage box according to claim 1, wherein a spray bottle for storing cleaning liquid is disposed in the second accommodating cavity.

8. The multifunctional electronic equipment cleaning storage box according to claim 7, wherein the box body defines two first embedding grooves and a second embedding groove, the two first embedding grooves are spaced apart and extend longitudinally, the small cleaning sweep and the spray bottle are respectively embedded in the two first embedded grooves to be fixed, the second embedding groove extends laterally and is communicated with the two first embedding grooves, a silica gel piece is embedded in the second embedding groove, and the silica gel piece supports the small cleaning sweep and the spray bottle.

9. The multifunctional electronic equipment cleaning storage box according to claim 1, wherein the first box cover is buckled, installed, and fixed with the box body, and the first box cover is a transparent cover.

10. The multifunctional electronic equipment cleaning storage box according to claim 1, wherein the second box cover is buckled, installed, and fixed with the box body, and a keyboard buckle is clamped on an inner side surface of the second box cover.

* * * * *